US006357378B1

(12) United States Patent
Hile

(10) Patent No.: US 6,357,378 B1
(45) Date of Patent: Mar. 19, 2002

(54) WATERCRAFT MOORING SYSTEM

(76) Inventor: Richard J. Hile, PMB 366, POB 8000 43 Sixth Ave., Page, AZ (US) 86040-8000

( * ) Notice: Subject to any disclaimer, the term of this patent is extended or adjusted under 35 U.S.C. 154(b) by 0 days.

(21) Appl. No.: 09/503,078

(22) Filed: Feb. 12, 2000

(51) Int. Cl.[7] ..... B63B 21/00

(52) U.S. Cl. ..... 114/230.2; 114/230.26; 114/293

(58) Field of Search ..... 114/230.1, 230.2, 114/230.22, 230.24, 230.26, 293

(56) References Cited

U.S. PATENT DOCUMENTS 3,838,657 A * 10/1974 Fleming ..... 114/230.2
4,022,450 A 5/1977 Smith, Jr.
4,258,608 A 3/1981 Brown
4,809,635 A 3/1989 Essig
4,864,956 A 9/1989 Onstwedder, Jr.
5,168,823 A 12/1992 Sheppard, Jr.
5,257,592 A 11/1993 Schaefer
5,390,618 A 2/1995 Wolff et al.
5,483,911 A 1/1996 Kubli

* cited by examiner

*Primary Examiner*—Jesus D. Sotelo
(74) *Attorney, Agent, or Firm*—Peter B. Scull

(57) ABSTRACT

A mooring system for watercraft for use with an anchor, the mooring system having an elongated anchor line which is attachable to an anchor; a connection member which is connected to the elongated anchor line; one or more shore lines which are connected to the connection member; and a watercraft attachment line which is connected to the shore line. The watercraft attachment line is then attachable to watercraft, preferably small and/or personal watercraft such as a "jet-ski(R)" watercraft or the like to moor the watercraft in offshore water.

14 Claims, 4 Drawing Sheets

WATERCRAFT MOORING SYSTEM

FIELD OF THE INVENTION

The present invention relates generally to systems and/or methods for mooring or anchoring small watercraft such as "jet-skis(R)" or the like in offshore water. More particularly, it involves a combination of lines and connection devices which are preferably detachably attachable both to an anchor and to such watercraft to securely moor the watercraft offshore.

BACKGROUND

A wide range of applications exist for mooring or anchoring watercraft in the water, offshore. One of the primary recognized benefits thereof includes avoiding causing damage to the watercraft as a result of wind, wave or wake action. When moored particularly on or very near the shore, such actions will often force the watercraft to repetitively impact against the shore (or similarly whether onshore or off, against other moored watercraft or against the mooring structures). These impacts can cause damage to the watercraft hull and/or to the propulsion system such as to a boat propeller, or in personal watercraft like "jet-ski(R)" watercraft, to the water intake for the impeller pump. Sand or other bottom material may become lodged in and obstruct the water intake when the personal watercraft is moored on or very near the shore.

A couple of examples of prior offshore watercraft mooring devices include Sheppard, Jr. (U.S. Pat. No. 5,168,823) and Kubli (U.S. Pat. No. 5,483,911), inter alia. Sheppard, Jr. teaches the use of an anchor line having a flexible hoop through which an activation line is operatively disposed. The activation line runs from the shore through the hoop and back to the shore. A human operator may then move the activation line through the hoop like a pulley to alternately move the boat to its offshore mooring place and back into the shore. Kubli teaches an elastic anchor rope which is attached at one end to the stern of a boat and at the other end to an anchor. The elasticity of the anchor rope allows for anchoring the boat offshore yet provides for the driving of the boat into the shore for the debarkation of the occupants, and then for the automatic elastic retraction of the boat to its offshore mooring location.

Even so, there remain numerous mooring problems not addressed by these and like devices. For example, there are instances where it is preferable to provide substantially static, yet simply adjustable mooring distances from the shore depending on the geography of a particular shoreline. It is also desirable to provide the option of mooring multiple watercraft adjacent one another on one anchor without permitting collisions therebetween. Further, stresses on an anchor line and/or one or more shore lines should also be relievable in order to prevent dislodgement of the anchor and the consequent drift of a watercraft into potentially damaging contact worth the shore or other watercraft. Such features would also preferably be available in a simply adaptable and portable device or system.

In view of the foregoing, it appears that many desiderata for mooring systems for small watercraft continue to be unmet. At the least, it is evident that it would be desirable to provide a portable mooring system offering simple, preferably adjustable operation for statically anchoring one or more watercraft yet also preferably providing secure endurance from the wind, wave and wake conditions inherent adjacent a shoreline.

SUMMARY OF THE INVENTION

The present invention relates generally to systems for mooring small and/or personal watercraft such as "jet-skis (R)" and the like in the water. More particularly, it involves a system of lines and connection devices which accomplish offshore anchoring of one or more of these watercraft while also providing for protection from impact damage caused by wind, wave or wake forces.

A system of connected lines is provided which is connectable to an anchor at one end and to one or more fixtures on shore at another end. At the anchor end of such a system, an elongated anchor line is attached to the anchor. This anchor line is also preferably connected to a ring or Y-shaped connection member to which one or more substantially fixed shore lines are connected. A ring is one preferred embodiment for the connection member because it allows any practical number of shore lines to be attached thereto. An alternative Y-shaped connection member providing for the connection of two fixed shore lines to the anchor line has other preferred features such as ensuring a fixed separation of the two shore lines from each other. Still other shapes of connection members are also contemplated herein.

While in use, the anchor is anchored in the water near the shore while the anchor and shore lines run toward the shore and the one or more free ends of the one or more shore lines are secured at the shore to fixtures such as stakes driven into the beach or tied to rocks, trees, or the like. Each of the one or more shore lines have one or more preferably movable watercraft lines attached thereto. The upper ends of the watercraft lines are detachably attachable to respective personal watercraft. These watercraft lines are preferably elastic in nature (like so-called "bungee" cords) to provide a damping effect countering wind, wave or wake action and the like. This helps alleviate stresses on the main anchor line and the shore lines.

Slidable gripping devices are preferred for the connection of each of the watercraft lines to each respective shore line so that the watercraft lines may be adjustably moved as desired to various anchoring positions along the lengths of the respective shore lines between the ring or Y-shaped connection member and the shore. The gripping action is preferably caused by a pivoting, toothed cam operated by a thumb lever. Float devices are also preferably strategically disposed along any or all of the above-described lines; the anchor line, the shore lines and the watercraft lines. Anchor and shore line floats are intended to preferably impart an approx mate 45 degree angle for the anchor and shore lines in the water relative to the horizontal while the floats on the respective watercraft lines preferably bring the respective watercraft lines to a substantially vertical orientation in the water.

The above-described watercraft lines are intended to be connected to the personal watercraft in such a manner, preferably to the respective bows, so as to hold the watercraft facing away from the shoreline. In holding "jet-ski(R)" or like personal watercraft using a bow connection, the impeller pump water intake is kept away from the shore so that it does not become obstructed with sand or other bottom material. Additional watercraft lines may be disposed shoreward of each of the first, above-described watercraft lines and connected to the respective sterns of the watercraft to maintain each watercraft in its anchored position facing away from the shore. Each such additional watercraft line would also preferably be connected to the corresponding shore line with a slidable gripping device such as those used for the elastic watercraft lines. If a shore line is long enough, more than one personal watercraft may be attached therealong.

Accordingly, the primary object of the present invention is to provide an improved mooring system for small watercraft.

Another object is the provision of a non-complex mooring system for small watercraft which is highly compact and portable.

Another object is to provide a mooring system having at least one elongated line which is substantially static or fixed between the anchor and the shore.

Yet another object is to provide a mooring system allowing for optional additional shore lines for optionally mooring one or more watercraft relative to one anchor.

Yet another object is to provide a mooring system which will withstand the wind, wave, and wake conditions inherent in near shore watercraft mooring.

Still another object is to provide a mooring system with adaptable and/or adjustable flexibility.

Still another object is to provide an adjustably movable connection component for adjusting for the length of a given vessel and/or for selecting a discrete mooring distance of the watercraft from the shore.

And, still one further object is to provide one or more float elements for bearing selected mooring lines of a watercraft mooring system in pre-selected orientations in the water.

These and still further objects are achieved by the present invention as will be demonstrated in the following description of preferred embodiments which should be examined in concert with the attached drawings in which like parts are identified by like numerals throughout the several views.

DETAILED DESCRIPTION OF THE PRESENT INVENTION

Figure 1:
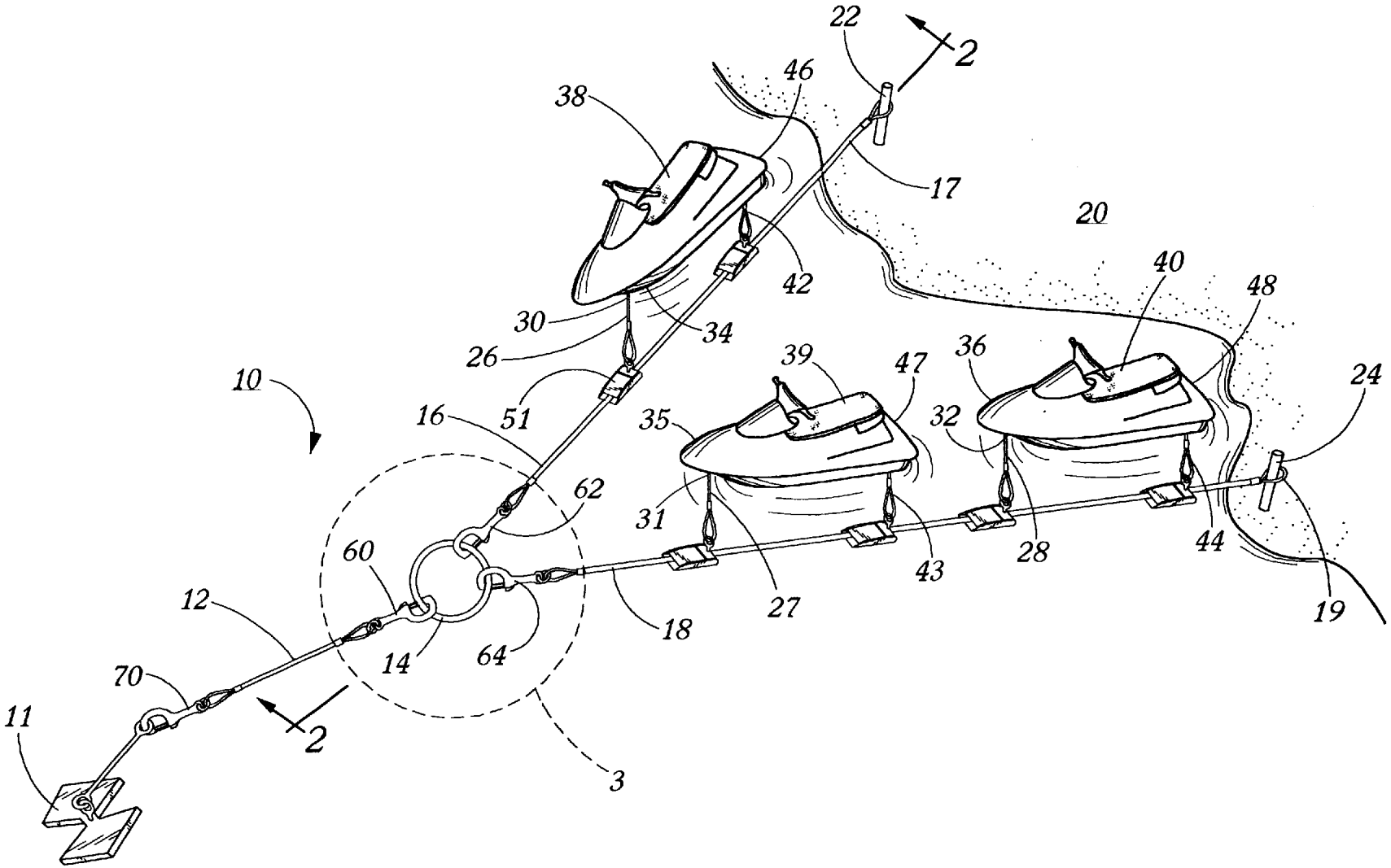
FIG. 1 is an isometric view of a mooring system according to the present invention.

A variety of preferred mooring systems according to the present invention are shown in the attached drawings and are generally identified by the reference numeral 10 therein. For example, in FIG. 1, a mooring system 10 is shown as preferably disposed in a body of water with various watercraft moored thereby.

In particular and among several details as will be described throughout this specification, the mooring system 10 is shown as detachably attached to an anchor 11. Anchor 11 (which, as will be discussed further below, may be of numerous alternative types such as "Danforth" or "Naval" among many others which the user may deem appropriate for the nature of the particular waterbody bottom with which they may be confronted) is preferably detachably attached to an elongated anchor line 12 of mooring system 10. Anchor line 12 is in turn preferably connected to a connection member 14 (which as shown in this FIG. 1 embodiment is a ring 14) to which one or more shore lines 16 and 18 are detachably connected. Anchor 11 is, while in use, anchored in the water near but distinctly away from the shore 20. From there, the combination of lines, anchor line 12 and shore lines 16 and 18, extend toward the shore 20 in a substantially static or fixed manner between the anchor and the shore. The free ends 17, 19 of shore lines 16 and 18 are secured at or near the shore 20 to respective fixtures, either as shown to respective stakes 22, 24 as driven into the beach, or these free ends 17, 19 may be tied to respective rocks or trees or like substantially stationary devices (not shown), or any combination thereof. Free ends 17, 19 may be simply free and then tied or otherwise secured to the respective substantially fixed object, or these ends may be formed into substantially fixed loops, as shown, or may make use of any of a large plurality of connection devices or mechanisms such as connecting rings, or snap, push-button or trigger hooks such as those described in further detail hereinbelow, or any other similar, equivalent or obvious connectors known or to be developed.

Each of the shore lines 16 and 18 has attached thereto one or more watercraft lines, such as the primary watercraft lines 26, 27 and 28 shown in FIG. 1. These watercraft lines are preferably connected to the respective shore lines in a slidably movable fashion. In particular, the respective lower ends of the primary watercraft lines 26, 27 and 28 are preferably movable along the length of each of the respective shore lines 16, 18 as will be described below. The respective upper ends 30, 31 and 32 of the primary watercraft lines 26, 27 and 28 are detachably attachable to the bows 34, 35 and 36 of respective personal watercraft 38, 39 and 40. Primary watercraft lines 26, 27 and 28 are preferably elastic in nature in order to provide a damping effect countering wind, wave, wake and like forces. This damping effect thereby counteracts the cyclic wind, wave and wake stresses imparted on the watercraft as well as on the anchor and shore lines 12, 16 and 18. Careful selection by the user, manufacturer, distributor or other decision-maker of certain lengths and/or resiliencies of these elastic watercraft lines may contribute still further toward providing a mooring system with adaptable and/or adjustable flexibility.

Secondary watercraft lines 42, 43 and 44 are also shown in FIG. 1 as preferably attached to the respective sterns 46, 47 and 48 of the watercraft 38, 39 and 40. The secondary watercraft lines may also be elastic in nature like the primary watercraft lines 26, 27 and 28. They may alternatively, and even perhaps preferably be non-elastic in nature when used with elastic primary lines 26, 27 and 28 in order to provide a relatively static counterbalance to such elastic primary lines. In either case, use of these secondary watercraft lines would thus provide greater mooring stability for she respective watercraft 38, 39 and 40 against any wind, wave and/or wake action present while these craft are moored in the water. Use of selected sizes and flexibilities of secondary watercraft lines preferably thereby provides further adaptable and/or adjustable flexibility for the mooring system.

Figure 2:
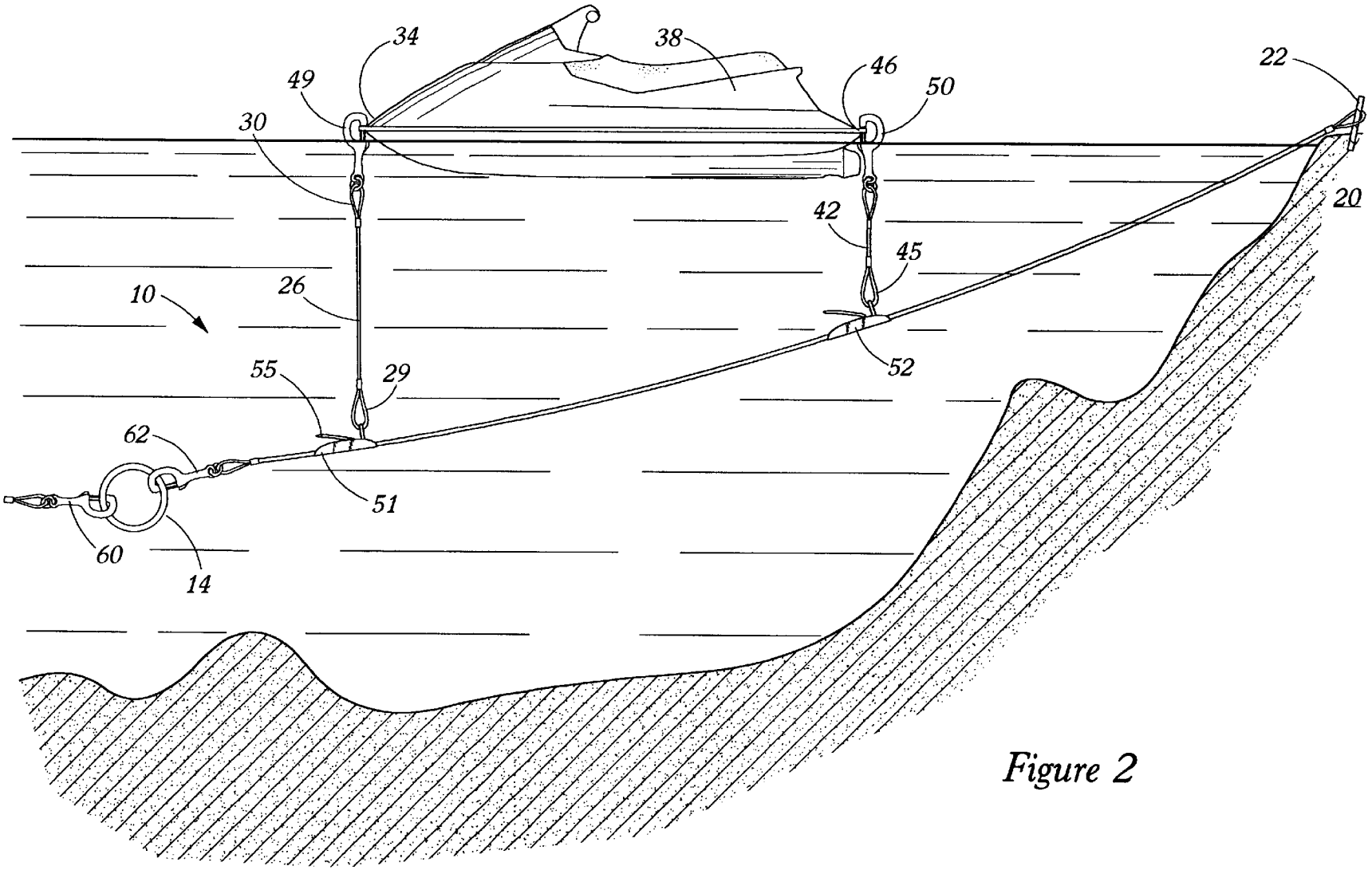
FIG. 2 is a side elevational view of a portion of the mooring system of FIG. 1 taken substantially as along line 2—2 thereof.

As shown in more detail in FIG. 2, a primary watercraft line 26 is connected to the respective bow 34 of the respective personal watercraft 38 to hold the watercraft sufficiently away from the shore 20 so that the water intake for the impeller pump (not directly shown) will not become obstructed with sand or other bottom material. The optional additional secondary watercraft line 42 is disposed shoreward of the respective primary watercraft line 26 and is connected to the respective stern 46 of the watercraft 38 to further ensure that watercraft 38 is securely moored bow out, facing away from the shore 20. Pushbutton hooks 49, 50 are preferred for making the actual connection of the respective primary and secondary watercraft lines 26, 42 to the watercraft 38. Pushbutton hooks 49, 50 may be of a sturdy, non-breakable nylon or plastic material, or a rust-proof, non-corrosive metal material preferably coated with a rubber or latex hot dip to prevent contact damage to the hull of the watercraft.

Slidable gripping devices, such as the devices 51, 52 shown in FIG. 2 (as well as devices 51, 53 as shown in more detail in FIGS. 4 and 4A), are preferred or the connection of all of the watercraft lines, both the respective primary lines 26, 27, 28 and the secondary lines 42, 43, 44, to the shore lines 16 and 18 so that any and/or all of these watercraft lines may be moved as desired to any of numerous mooring positions along the lengths of the shore lines 16 and 18 as desired. As shown in FIG. 2, the respective lower ends 29, 45 of the respective watercraft lines 26, 42 are connected to the respective slidable gripping devices 51, 52. These connections may be of a substantially permanent nature as shown or a detachable nature using snap or pushbutton or other hooking or connection devices or mechanisms such as is described for various other hardware connections herein, or as would be equivalent or obvious herefrom.

Figure 4:
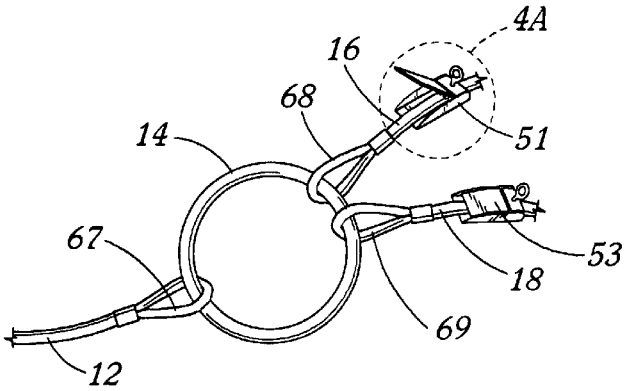
FIG. 4 is an enlarged view as in FIG. 3 of an alternative embodiment of the present invention.
Figure 4A:
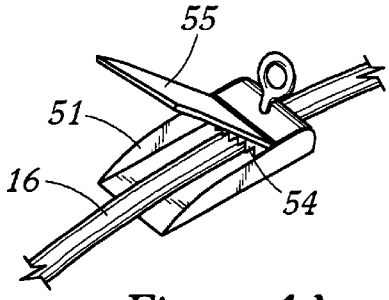
FIG. 4A is an enlarged view of the circled area labelled 4A in FIG. 4.

As shown in FIG. 4A, the presently preferred gripping action of all of the slidable devices used herein is preferably effected by respective pivoting toothed cams such as the cam 54 which is connected to and thereby engaged by operation of the respective thumb lever 55 on device 51. Though not shown in detail in the drawings, each optional secondary watercraft line 42, 43, 44 is preferably also connected to the respective shore line 16 or 18 with a slidable gripping device such as the device 52 shown in FIG. 2. These again, would preferably be like those introduced and described above for primary lines 26, 27 and 28. All of these slidable gripping devices provide adjustably movable connection components for adjusting for the length of a given watercraft vessel and/or for selecting a discrete mooring distance of the watercraft from the shore.

Figure 3A:
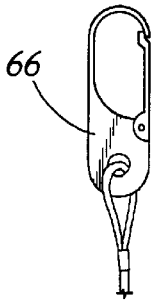
FIG. 3A is an enlarged view of an alternative connection mechanism usable in the present invention.
Figure 3:
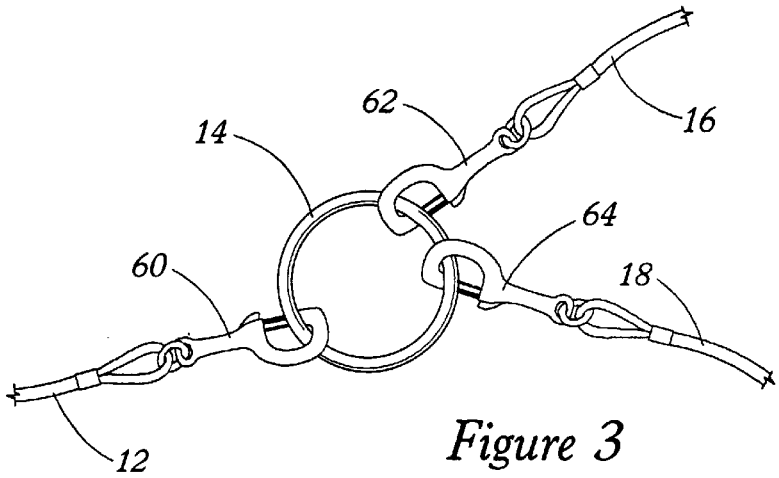
FIG. 3 is an enlarged view of the circled area labelled 3 in FIG. 1.
Figure 5:
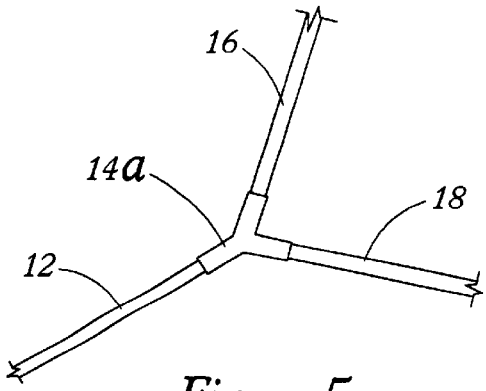
FIG. 5 is another enlarged view as in FIG. 3 of another alternative embodiment of the present invention.

As shown in FIGS. 1 and 2 and in more detail in FIGS. 3 and 4, the ring-shaped connection member 14 is preferred in that it allows any practical number of shore lines 16, 18 and so on (others more than two, not shown) to be attached thereto. However, an alternative to a ring 14 is a Y-shaped connection member 14*a* as shown in FIG. 5 which provides for the connection of two fixed shore lines 16 and 18 to anchor line 12. A Y-shaped connection member 14*a* provides an advantage of a fixed separation angle of adjacent shore lines 16, 18 from each other to thereby minimize the potential for moored watercraft to collide with each other.

Note, when considering alternative embodiments of connection members, a minimum of one shore line (such as a single line 16, see e.g., FIG. 2) is contemplated with a maximum usable number of shore lines dictated primarily by user choice and/or geographical and/or other practical limitations. It is thus foreseeable that one, two, three or many more lines may be connected via one or more connection member(s) to an anchor line 12 so long as adequate mooring distances may be maintained between the respective watercraft and or other geographical or physical constraints. Moreover, in one possibly more basic alternative embodiment, the anchor line 12 may be considered coincident with a single shore line such that no connection member 14 is necessary. Then, at least one and/or any practical number of watercraft attachment lines (primary and/or secondary) can be connected to such a anchor/shore line. A single, substantially stationary or fixed elongated anchor/shore line would be the result with one or more watercraft attachment lines connected thereto. These watercraft attachment lines would preferably, but not necessarily be slidably connected thereto to provide adjustable mooring distances along the length of the elongated anchor/shore line.

On the other hand, multiple connections could be used to provide not only single or multiple shore line connections to one connection member 14, but also a plurality of connection members 14 and/or anchor lines 12 may be used to connect a still further plurality of shore lines thereto. Note, it is foreseeable that a number of connection members 14 could be used in parallel or even in series, or in a combination of both. The limits would again be dictated by user choice and geographic or other practical constraints. In either event, whether a single elongated line or combination of a plurality of lines is stretched from anchor to shore, it is preferred that the anchor/shore line(s) be disposed in a substantially static or fixed relation between the anchor and the shore in use. Substantially static or fixed means substantially immovable while in use for mooring and/or disconnecting watercraft. Some movement will likely still be experienced due to external forces such as the wind, wave, wake and/or other substantially natural forces; however, the shore and anchor lines remain in substantially static or fixed disposition relative to the operator while in use.

One set of preferred hardware used for the connections of the respective anchor and shore lines in the respective orientations described here are pushbutton hooks 60, 62 and 64 as shown for example in FIGS. 1–3. Pushbutton hook 60 connects anchor line 12 to connection member ring 14 and pushbutton hooks 62 and 64 similarly connect shore lines 16, 18 thereto. These pushbutton hooks 60, 62 and 64 are preferably formed of a non-corrosive metal material or a sturdy, non-breakable nylon or plastic. Either way, they may be covered with a rubber or latex material as was described with respect to the pushbutton hooks 49, 50 described above, although these hooks are less likely to regularly come into contact with the watercraft hull, and thus constitute a lesser risk for damage thereto. A more important consideration is making these rust-proof, or otherwise protected from extended exposure to a water environment.

Alternative hardware may also be used as illustrated for example by the hinged, spring activated snap hook 66 shown in FIG. 3A; or by the more irremovable ferrule and thimble type loop connections 67, 68 and 69 shown in FIG. 4. Both the detachable and the more substantially permanent connections such as these are within the scope of the present invention but the relatively irremovable styles are less well preferred in view of the detachably attachable connections shown and described hereinabove due to the inherent limitations these present the user wishing to use various of the optional embodiments described here and/or inherent or obvious herefrom. Other detachably attachable connection members such as any of a plurality of other snap or button or trigger hooks (no shown), whether now known or yet to be developed, may also be used in the invention described herein without departing from the scope thereof.

Similarly, the connection of the anchor 11 to the system 10 may be of a substantially or semi-permanent nature making it thereby a component part of system 10, or as shown in FIG. 1, for example, this connection may be a detachable attachment accomplished with a sturdy pushbutton or snap hook 70 (see FIG. 1) made preferably of a rust-proof, non-corrosive metal. Detachability provides numerous benefits such as allowing for use of the mooring system 10 with any of various otherwise available anchors; and particularly so that a single system 10 of lines and hardware may be serially used with different, distinct anchors depending on the prevailing conditions during use. Thus, if in one particular application, the mooring location presents a sandy bottom, a Danforth type of anchor may be used as will be appreciated by the artisan. Or, if a rocky bottom is presented by the particular geography, then a Naval type of anchor may be chosen. Any of a large plurality of other anchor types may similarly be substituted and used herein, again as will be understood by the artisan.

In the preferred embodiment, the anchor and shore lines 12 and 16, 18 (et alia, if used), are preferably made of a strong, yet lightweight braided nylon or like sturdy, flexible materials, and are preferably of the three-eighths inch (⅜") diameter type for use in the preferred embodiment with small or personal watercraft. These and alternative materials and sizes preferably also present a consistency that promotes floating of the line. If long enough, and as shown for shore line 18 in FIG. 1, for example, one or two personal watercraft (see watercraft 39 and 40) or even more may be attached along one or the other or both shore lines 16 and 18. In one preferred embodiment, lines 16 and 18 are 20 feet long and anchor line 12 is 30 feet long. All lines are also preferably brightly colored to enhance visual recognition when the lines are disposed in or on the water.

The connection member (either ring 14 or Y-shaped member 14*a* or like substitutes herefor) is preferably made of metal, although it could be of other materials such as plastic, inter alia. As mentioned the primary watercraft lines 26, 27 and 28 are preferably elastic in nature. A so-called "bungee" cord material is preferred. The secondary watercraft lines 42, 43 and 44 could also be elastic (whether of "bungee" material or otherwise); however, in a preferred embodiment as described, non-elastic secondary watercraft lines may be used and these would then preferably be made from a braided nylon or a like material.

Figure 6:
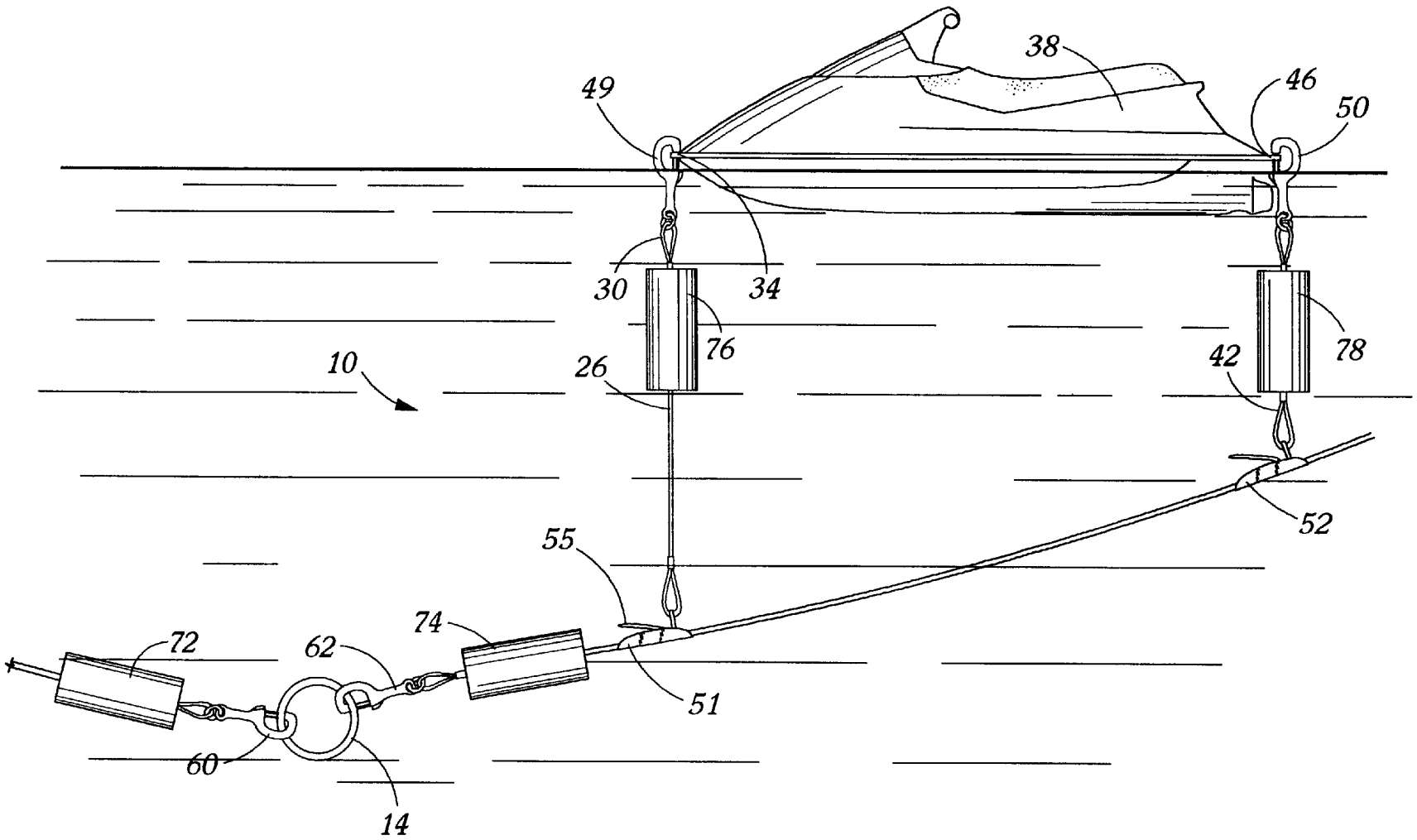
FIG. 6 is a side elevational view similar to that shown in FIG. 2 of yet another alternative embodiment of the present invention.

The present invention also preferably includes float devices, preferably of hollow core foam material covered with a hard plastic shell, disposed on the anchor line 12 at the connection to or near the connecting ring structure 14 as well as on each of the shore lines 16, 18 also near ring 14. Floats are also preferred on all the watercraft lines both the primary watercraft lines 26, 27 and 28 and the secondary lines 42, 43, and 44, if used. In particular, as shown in FIG. 6, representative float devices 72 and 74 are strategically disposed respectively on anchor line 12 and shore line 16, and similar float devices 76, 78 are disposed as shown respectively on primary and secondary waterscraft lines 26 and 42. Floats 72 and 74 are in tended to preferably impart an approximate 45 degree angle (not shown) to anchor and shore lines 12 and 16 (and 18, et alia, if used) relative to the horizontal while floats 76, 78 preferably bring the watercraft lines 26 and 42 to a substantially vertical orientation in the water. Floats of approximately six inches (6") in length and two to three inches (2"–3") in diameter are preferred. In another embodiment, the floats 72 and/or 74 may preferably bring the connection member 14 to or very near the water surface as would the other floats 76, 78 (e al., if used) also bring their respective lines to the water surface. This would ensure th at the mooring system 10 would not become completely submerged, and perhaps irretrievable. Moreover, this would provide increased visibility for the mooring system 10 by the user or other persons and thus decrease the possibility that a watercraft would be maneuvered too close to and/or over a line or other portion of the system which could be ingested into the impeller or otherwise disrupt or damage a propulsion system such as a boat propeller.

As described, the mooring system 10 includes elements which are strong, yet capable of being reduced to a compact mass for simple storability and consequent portability. For example, when detached from the anchor 11, she anchor line 12 and one or more shore lines 16, 18 (et alia, if used) may be simply coiled to individual compact masses and/or coiled together into one compact coiled mass (none shown). If coiled separately, the respective lines 12, 16, 18 (et alia) may be detached from the connection member 14 by disconnection of the pushbutton hooks 60, 62, 64 therefrom, or they may be retained thereon as desired. The respective watercraft lines (primary and/or secondary, as used) may similarly also be coiled into compact masses separately or together with the anchor and/or shore lines for storage as well. Also similarly, the watercraft lines may be detached from their respective shore lines; by either sliding the slidable gripping devices off either end (the free end or the other end detachably attached to the connection member) of the respective shore line or by disconnecting a detachable connection (not shown) of the watercraft line to the slidable gripping device as described above.

The resulting coiled or otherwise compacted mass of lines and included hardware (for example, hooks, ring 14, slidable gripping devices, etc.) may then be simply stored in a compact location such as in an internal storage compartment disposed in a personal watercraft (such as any of the watercraft 38, 39, 40) shown and otherwise discussed herein. A similarly compact carrying case or bag (not shown) may also be used to contain the compact mass. Certain anchors 11 may also be compact enough to be stored in such an internal storage compartment as well. Portability in this fashion is a distinct advantage of the present invention.

In use, the mooring system 10 would at first, be removed from its storage compartment and/or other container (case, bag or the like), and if not already reconnected to each other, all of the various lines desired to be used during a particular outing are connected into relative orientations as shown and described above including any preferred or otherwise selected optional embodiments. Then, if the system 10 does not already include an anchor 11, then the mooring system 10 is connected thereto. The anchor 11 may then be set in place offshore on the floor of the body of water in which the watercraft is to be moored. Usually, it is believed that the present invention would preferably be used in relatively shallow water easily accessible by a wader, a person wading thereto from shore. Either before or after setting the anchor in the anchoring position in the water, the free end and/or ends (such as ends 17 and/or 19 (et alia, if used)) are connected to substantially fixed objects on or near shore 20. These substantially fixed objects may be stakes 22, 24 as shown in FIG. 1, or any alternative as described above or otherwise equivalent structures thereto. Then, one or more watercraft, such as watercraft 38, 39 and/or 40 as shown in FIG. 1, are maneuvered into mooring position, preferably bow out also as shown in FIG. 1, and connected to the mooring system 10 via a pushbutton hook connection device 49 and/or connection device 50 (FIG. 2) as these extend from primary watercraft line 26 and/or secondary watercraft line 42 used), respectively. The user (not shown) may then wade or swim from or otherwise leave the watercraft being content that the watercraft is securely moored. Note, the slidable gripping devices may be moved to a desired location at any point in time during this process as desired; e.g., before the mooring system 10 is disposed in the water, or after the system is put in the water and either before or after the watercraft has been connected to one or the other of primary and/or secondary watercraft lines.

In reverse fashion, in order to free the watercraft for use in pursuit of its intended purpose, the user may wade or swim from shore or be transported in any other manner to the watercraft. Then, the user may disconnect the connection hooks 49 and 50 (FIG. 2), cast off the watercraft lines and ride the watercraft as desired. The user may then re-moor the watercraft and cast off again and again, until the user desires to dislodge the anchor 11 and coil up (or otherwise compact) the lines of the mooring system 10 and stow the system as described above (preferably in a highly portable manner, for example in a watercraft storage compartment), until the next outing.

It should be noted as an alternative that any type of watercraft including boats of many types and sizes may make use of mooring systems such as those described in the preferred small or personal watercraft embodiments herein. Adaptations in materials, strength and scale would perhaps be required for such different applications, but these adaptations are within the skill of the artisan.

From the foregoing, it can readily be discerned that a new and useful invention has been shown and described which achieves the desired purposes therefor in a new and unapparent manner. All modifications which may readily occur to an artisan are fully intended within the spirit and scope of this invention which is limited solely by the claims appended hereto.

Accordingly, what is claimed is:

1. A mooring system for use with an anchor to moor watercraft in offshore water, said mooring system comprising:

an elongated anchor line which is attachable to an anchor;

a connection member which is attached to said elongated anchor line;

a shore line which is connected to said connection member, said shore line also being adapted to be connected to a fixture on shore; and a watercraft line which is connected to said shore line; said watercraft line being connectable to watercraft to moor the watercraft in a body of water offshore.

2. A mooring system according to claim 1 which further comprises an anchor attached to said elongated anchor line.

3. A mooring system according to claim 1 in which said connection member is a ring.

4. A mooring system according to claim 3 in which said ring connection member provides for connection of at least one further shore line thereto.

5. A mooring system according to claim 1 in which said connection member is a Y-shaped member.

6. A mooring system according to claim 5 in which said Y-shaped connection member provides for connection of a second shore line thereto.

7. A mooring system according to claim 1 in which the watercraft line is connected to the shore line by a sliding gripper connection.

8. A mooring system according to claim 1 in which said at least one shore line is detachably connected to said connection member.

9. A mooring system according to claim 1 in which the watercraft line is of an elastic nature; whereby the elastic nature of the watercraft line provides a damping effect.

10. A mooring system according to claim 1 in which the anchor line has a float disposed thereon.

11. A mooring system according to claim 1 in which the shore line has a float disposed thereon.

12. A mooring system according to claim 1 in which the watercraft line has a float disposed thereon.

13. A mooring system according to claim 1 which further comprises a secondary watercraft line connected to the shore line which provides for connection to the stern of the watercraft.

14. A mooring system according to claim 13 in which the secondary watercraft line is connected to the shore line by a sliding gripper connection.

* * * * *